US008480083B2

(12) United States Patent
Kuroda

(10) Patent No.: US 8,480,083 B2
(45) Date of Patent: Jul. 9, 2013

(54) MANAGING APPARATUS, IMAGE FORMING APPARATUS, METHOD OF CONTROLLING THE MANAGING APPARATUS, AND STORAGE MEDIUM

(75) Inventor: Yuji Kuroda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 106 days.

(21) Appl. No.: 12/824,044

(22) Filed: Jun. 25, 2010

(65) Prior Publication Data

US 2011/0024967 A1 Feb. 3, 2011

(30) Foreign Application Priority Data

Jul. 28, 2009 (JP) ..... 2009-175381

(51) Int. Cl.
*B65H 7/02* (2006.01)
*B65H 5/26* (2006.01)

(52) U.S. Cl.
USPC ..... 271/265.01; 271/9.01

(58) Field of Classification Search
USPC ..... 271/265.01, 9.01
See application file for complete search history.

(56) References Cited

U.S. PATENT DOCUMENTS

| | | | | |
|---|---|---|---|---|
| 5,651,542 | A * | 7/1997 | Yamauchi et al. | 271/122 |
| 6,193,426 | B1 * | 2/2001 | Guillemin | 400/605 |
| 6,881,972 | B2 * | 4/2005 | Butikofer et al. | 250/559.29 |
| 2003/0173736 | A1 * | 9/2003 | Yano | 271/264 |
| 2003/0205862 | A1 * | 11/2003 | Guddanti et al. | 271/122 |
| 2007/0001366 | A1 * | 1/2007 | Yano | 271/9.01 |
| 2007/0158895 | A1 * | 7/2007 | Hamahashi | 271/10.03 |
| 2008/0048392 | A1 * | 2/2008 | Hamahashi | 271/265.01 |
| 2008/0226372 | A1 * | 9/2008 | Loh et al. | 400/76 |
| 2009/0057992 | A1 * | 3/2009 | Katou et al. | 271/227 |
| 2009/0285586 | A1 * | 11/2009 | Kawaguchi | 399/12 |

FOREIGN PATENT DOCUMENTS

| | | |
|---|---|---|
| JP | 2001-005351 | 1/2001 |
| JP | 2004-149242 | 5/2004 |

* cited by examiner

*Primary Examiner* — Patrick Cicchino
(74) *Attorney, Agent, or Firm* — Canon USA Inc. IP Division

(57) ABSTRACT

Degrees of wear of sheet-feed rollers corresponding to sheet-feed cassettes are managed by considering types of sheets set at feeding units. A control method for controlling a managing apparatus for managing a feeding device that feeds sheets, set in the feeding units, by driving the sheet-feed rollers corresponding to the feeding units includes storing sheet information in a storage unit, the sheet information indicating types of the sheets that are set in the respective feeding units; and managing degrees of wear of the sheet-feed rollers for the respective feeding units in accordance with the numbers of fed sheets and the sheet information stored in the storage unit, the degrees of wear resulting from the sheets fed from the feeding units.

11 Claims, 9 Drawing Sheets

● A4 SHEET RUNNING TEST ▒ A4 SHEET-RUNNING-TEST SHEET

FIG. 4

| FORM | SURFACE PROPERTY | 52 – 63 | 52 – 79 | 80 – 105 | 106 – 128 | 129 – 150 | 151 – 180 | 181 – 209 | 210 – 256 | 257 – 300 |
|---|---|---|---|---|---|---|---|---|---|---|
| NORMAL | FINE QUALITY SHEET | THIN SHEET | THIN SHEET | ORDINARY SHEET 500K | THICK SHEET | THICK SHEET 2 | THICK SHEET 3 | THICK SHEET 4 380K | THICK SHEET 5 | THICK SHEET 6 250K |
| | FINE QUALITY SHEET | | COLORED SHEET | | | | | | | |
| | RECYCLED SHEET | | RECYCLED SHEET | RECYCLED SHEET 2 | THICK SHEET | THICK SHEET 2 | THICK SHEET 3 | THICK SHEET 4 | RECYCLED SHEET 3 | THICK SHEET 6 |
| | ONE-SIDE COATING | | | ONE-SIDE COATED SHEET 1 350K | ONE-SIDE COATED SHEET 2 | ONE-SIDE COATED SHEET 3 | ONE-SIDE COATED SHEET 4 330K | ONE-SIDE COATED SHEET 5 | ONE-SIDE COATED SHEET 6 280K | |
| | TWO-SIDE COATING | | | TWO-SIDE COATED SHEET 2 280K | TWO-SIDE COATED SHEET 2 | TWO-SIDE COATED SHEET 3 | TWO-SIDE COATED SHEET 4 240K | TWO-SIDE COATED SHEET 5 | TWO-SIDE COATED SHEET 6 180K | |
| | EMBOSS | | | EMBOSSED SHEET 250K | EMBOSSED SHEET 2 | EMBOSSED SHEET 3 | EMBOSSED SHEET 4 200K | EMBOSSED SHEET 5 | EMBOSSED SHEET 6 | EMBOSSED SHEET 7 120K |
| | PELHAM | | | PELHAM SHEET | PELHAM SHEET 2 320K | | | | | |
| | FILM | | | | | | OHP 300K | | | |
| | LABEL | | | | LABEL SHEET 380K | | | | | |
| | COTTON | | | BOND SHEET 180K | | | | | | |
| TAB SHEET | FINE QUALITY SHEET | | | | | | INDEX SHEET 1 | INDEX SHEET 2 300K | | |
| PUNCH SHEET | FINE QUALITY SHEET | | PUNCHED SHEET 1 | PUNCHED SHEET 2 400K | | | | | | |

FIG. 5

SHEET-FEED CASSETTE C1

| FORM | SURFACE PROPERTY | TYPE | SIZE SHEET-FEED DIRECTION (mm) | NUMBER OF SHEETS THAT ARE FED | NUMBER OF SHEETS AFTER A4-SIZE CONVERSION | NUMBER OF SHEETS IN TERMS OF WEAR | DEGREE OF WEAR P1/P2 |
|---|---|---|---|---|---|---|---|
| NORMAL | FINE QUALITY SHEET | ORDINARY SHEET | A4 210 | 50K | P1 50K | P2 500K | 10.0% |

SHEET-FEED CASSETTE C2

| FORM | SURFACE PROPERTY | TYPE | SIZE SHEET-FEED DIRECTION (mm) | NUMBER OF SHEETS THAT ARE FED | NUMBER OF SHEETS AFTER A4-SIZE CONVERSION | NUMBER OF SHEETS IN TERMS OF WEAR | DEGREE OF WEAR ((P1 × P2'/P2) + P1')/P2' |
|---|---|---|---|---|---|---|---|
| NORMAL | FINE QUALITY SHEET | THICK SHEET 5 | A4 210 | 520 | P1 520 | P2 250K | 18.6% |
| NORMAL | ONE-SIDE COATING | ONE-SIDE COATED SHEET 3 | LGL 355.6 | 36K | P1' 61K | P2' 330K | |

SHEET-FEED CASSETTE C3

| FORM | SURFACE PROPERTY | TYPE | SIZE SHEET-FEED DIRECTION (mm) | NUMBER OF SHEETS | NUMBER OF SHEETS AFTER A4-SIZE CONVERSION | NUMBER OF SHEETS IN TERMS OF WEAR | DEGREE OF WEAR P1/P2 |
|---|---|---|---|---|---|---|---|
| NORMAL | EMBOSS | EMBOSSED SHEET 7 | A3 420 | 50K | P1 100K | P2 120K | 83.3% |

⋮

SHEET-FEED CASSETTE C8

| FORM | SURFACE PROPERTY | TYPE | SIZE SHEET-FEED DIRECTION (mm) | NUMBER OF SHEETS | NUMBER OF SHEETS AFTER A4-SIZE CONVERSION | NUMBER OF SHEETS IN TERMS OF WEAR | DEGREE OF WEAR ((P1 × P2'/P2) + P1')/P2' |
|---|---|---|---|---|---|---|---|
| NORMAL | TWO-SIDE COATING | TWO-SIDE COATED SHEET 1 | 12 × 18 457.2 | 20K | P1 43K | P2 280K | 46.0% |
| TAB SHEET | FINE QUALITY SHEET | INDEX SHEET 2 | 13 × 19 482.6 | 40K | P1' 92K | P2' 300K | |

SHEET-FEED CASSETTE C3 SETTING SCREEN

MANAGING APPARATUS, IMAGE FORMING APPARATUS, METHOD OF CONTROLLING THE MANAGING APPARATUS, AND STORAGE MEDIUM

BACKGROUND OF THE INVENTION

1. Field of the Invention

The present invention relates to a managing apparatus, an image forming apparatus, a method of controlling the managing apparatus, and a storage medium.

2. Description of the Related Art

A related sheet-feeding device of, for example, a copying machine or a printer includes a plurality of feeding units (including sheet-feed cassettes or sheet-feed trays). Sheets held in the respective feeding units are conveyed to an image forming section by driving respective sheet-feed rollers. However, when the surfaces of the sheet-feed rollers are worn while sheet-feeding is performed, it becomes difficult to feed the sheets. In general, the lives of the sheet-feed rollers tend to be shorter than the life of the main body of the image forming apparatus.

Therefore, it may become necessary to replace parts including the sheet-feed rollers during the time in which the image forming apparatus can still be used.

However, when the sheet-feeding device of the image forming apparatus includes a plurality of feeding units, the rates of use of the feeding units are not the same.

This is because, when the sizes of the sheets held by the respective feeding units are different from each other, the rate of use of any feeding unit for the sheet size that is frequently used is increased, and the rate of use of the any feeding unit for the sheet size that is not frequently used is reduced. In addition, when a plurality of feeding units where sheets of the same size are set are provided, the rates of use of the feeding units may become different from each other due to a feeding method in which, for the purpose of increasing throughput of one printing, sheet-feed operations are sequentially performed starting with the feeding unit where a sheet-conveyance time to the image forming section is short.

By this, the lives of only particular feeding units end quickly, whereas the other sheet-feed cassettes are not frequently used until the lives of these particular feeding units end. Accordingly, the lengths of time required for the feeding units to reach the end of their lives differ from each other. Therefore, a service personnel who replaces parts, such as sheet-feed rollers, of the feeding units of the sheet-feeding device must frequently replace the parts including the sheet-feed rollers. Accordingly, the efficiency with which the service personnel performs maintenance is reduced because the lives of the sheet-feed rollers of the respective feeding units differ from each other.

Accordingly, for example, a method of performing sheet-feeding by integrating a driving time for each of a plurality of sheet-feed rollers and by preferentially selecting a feeding unit corresponding to any sheet-feed roller whose integrated driving time is short is available (refer to Japanese Patent Laid-Open No. 2001-005351).

Another method of performing sheet-feeding by counting and controlling the number of sheets that have been fed for each of a plurality of feeding units and by selecting the feeding unit that has fed a small number of sheets when automatic selection of the feeding unit is set is also available (refer to Japanese Patent Laid-Open No. 2004-149242).

Managing apparatuses that manage sheet-feeding devices using these methods are being considered.

Recent sheet-feeding devices can handle sheets of many sizes and types and allow these sheets to be set at feeding units for feeding the sheets.

However, related methods are not methods that manage the degree of wear of sheet-feed rollers of the feeding units by considering types of sheets that are becoming diversified in recent years.

In particular, the amounts of wear of sheet-feed rollers depend upon the types of sheets. For example, when sheet types differ, the basis weights and the surface properties of the sheets differ. Therefore, when the sheets are fed, the amounts of wear of the sheet-feed rollers also differ. More specifically, when thick sheets are fed, the lives of the sheet-feed rollers end more quickly than when ordinary sheets are fed. In addition, when one-side coated sheets are fed, the lives of the sheet-feed rollers end more quickly than when ordinary sheets are used.

Accordingly, if the difference between the wear amounts of the sheet-feed rollers due to the types of sheets are not considered, the degrees of wear of the sheet-feed rollers cannot be properly known.

SUMMARY OF THE INVENTION

The present invention provides an managing apparatus for managing a feeding device that feeds sheets by driving sheet-feed rollers corresponding to feeding units, the sheets being set in the feeding units. The managing apparatus includes a storage unit configured to store sheet information indicating types of the sheets that are set in the respective feeding units; and a managing unit configured to manage degrees of wear of the sheet-feed rollers for the respective feeding units in accordance with the numbers of fed sheets and the sheet information stored in the storage unit, the degrees of wear resulting from the sheets fed from the feeding units.

Further features of the present invention will become apparent from the following description of exemplary embodiments with reference to the attached drawings.

BRIEF DESCRIPTION OF THE DRAWINGS

FIG. 4 illustrates information of characteristics of sheet-feed rollers.

FIG. 5 shows degrees of wear resulting from wear of the sheet-feed rollers.

DESCRIPTION OF THE EMBODIMENTS

First Embodiment

Figure 1:
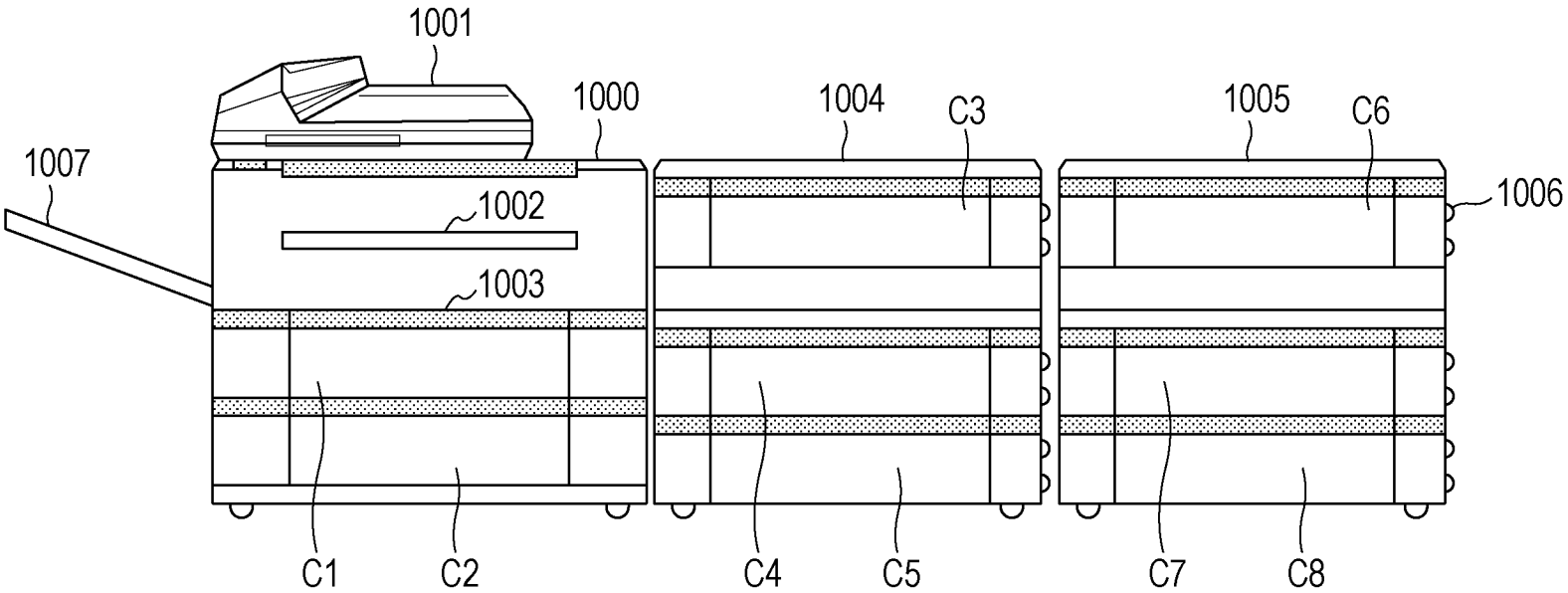
FIG. 1 shows the structure of a printing system which uses an image forming apparatus.

FIG. 1 shows the structure of an image forming system (printing system) according to an embodiment of the present invention. In this system, a sheet-feed deck 1004 and a sheet-feed deck 1005 are connected to one image forming apparatus 1000 (printing device). In the image forming system according to the embodiment, the number of sheet-feed decks that are connected is not limited to that in the embodiment. A method of managing members that wear in the image forming apparatus that conveys sheets (such as recording sheets), held in feeding units, by driving sheet-feed rollers will hereunder be described in detail. The sheet-feed decks 1004 and 1005 are formed so as to be connectable to a sheet-feed unit 1003, and include a plurality of sheet-feed cassettes.

In the embodiment, exemplary structures including sheet-feed units other than the sheet-feed units of the image forming apparatus where the sheet-feed decks are connected will be described. However, one image forming apparatus may include a plurality of sheet-feed units. In addition, the sheet-feed cassettes are made to correspond with sheet-feed rollers (not shown). By driving the sheet-feed rollers, sheets held in the sheet-feed cassettes are separated one at a time, and are fed into a conveyance path. When the sheet-feed rollers feed more than a predetermined number of, for example, A4-size sheets, the surfaces of the sheet-feed rollers wear, as a result of which friction force between the sheets and the sheet-feed rollers is reduced. The reduction in friction force prevents the sheets from being fed, thereby increasing the probability of sheet jamming. To overcome this problem, every time the number of sheets fed by the sheet-feed rollers reaches the predetermined number of sheets, a service personal replaces the sheet-feed rollers, to manage the number of sheets so as to restrict the jamming of the sheets. The sheet-feed cassettes are capable of holding, for example, thick sheets and one-side coated sheets in addition to ordinary sheets. Wear of the surfaces of the sheet-feed rollers caused by sheet-feeding is also controlled by the image forming system (more specifically, a controller unit 1002).

The sheet-feed rollers are made to correspond with the sheet-feed cassettes. One or more sheet-feed rollers are used. The sheet-feed rollers are provided at main body sides of the sheet-feed decks 1004 and 1005 and the image forming apparatus 1000. When the sheet-feed cassettes are mounted, the sheet-feed rollers are set on the sheets in the sheet-feed cassettes. Alternatively, the sheet-feed cassettes may include the sheet-feed rollers. In this case, when the sheet-feed cassettes are provided at the main body sides of the sheet-feed decks 1004 and 1005 and the image forming apparatus 1000, the sheet-feed rollers may be driven on the basis of an instruction from the image forming system.

In FIG. 1, reference numeral 1001 denotes a scanner unit including an automatic document feeding unit (ADF) and an optical unit. Image data of an original that has been scanned is subjected to image processing, and the processed image data is output to the controller unit 1002.

Reference numeral 1003 denotes a sheet-feed unit at the main body of the image forming apparatus 1000. In synchronism with sheet-feed timings of both the controller unit 1002 and a device controller unit (not shown), the sheets are conveyed to a printer unit 2095 in the interior of the main body. Here, the sheet-feed unit 1003 includes sheet-feed cassettes C1 and C2.

By a similar sequence, from the sheet-feed decks 1004 and 1005, the sheets are conveyed to the main body of the image forming apparatus 1000 through sheet-feed rollers 1006. The sheets that have been conveyed to and that have been subjected to printing by the main body of the image forming apparatus 1000 are ejected to a sheet-ejecting section 1007 of the image forming apparatus 1000. A side situated rightward of the main body of the image forming apparatus 1000 shown in FIG. 1 is called an "upstream side," and a side situated leftward of the main body of the image forming apparatus 1000 is called a "downstream side." If a post-processing device that performs a stapling operation or a binding operation is provided downstream from the image forming apparatus 1000, the sheets that have been printed at the main body of the image forming apparatus 1000 are conveyed to the post-processing device. The sheet-feed unit 1004 includes sheet-feed cassettes C3, C4, and C5. The sheet-feed unit 1005 includes sheet-feed cassettes C6, C7, and C8.

Exemplary Structure of Controller Unit

Figure 2:
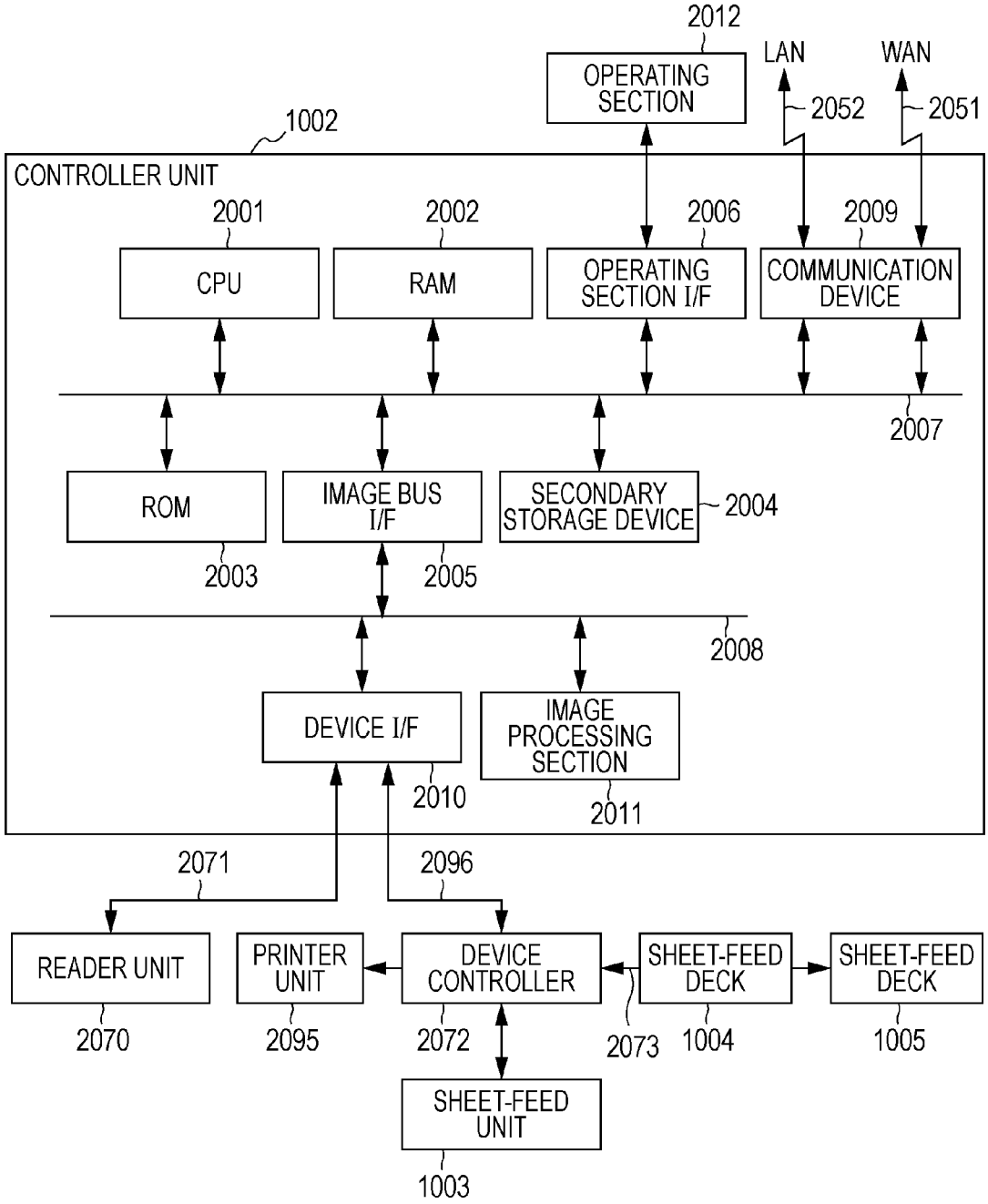
FIG. 2 is a block diagram illustrating the structure of the image forming apparatus.

FIG. 2 is a block diagram of the structure of the controller unit 1002 shown in FIG. 1 and the device controller that controls the sheet-feed decks.

In FIG. 2, the controller unit 1002 functions as a managing device that manages the sheet-feed units and an image input device. The controller unit 1002 is connected to a reader unit 2070 and to the printer unit 2095 serving as an image output device.

By connecting the controller unit 1002 to a local area network (LAN) 2052 and to a public line (a wide area network (WAN)) 2051 through a communication device 2009, input and output of image information and device information are performed.

A central processing unit (CPU) 2001 performs sheet-feed-section controlling operations (described later) by loading a control program, stored in ROM 2003 or secondary storage device 2004, to RAM 2002, and executing the control program. RAM 2002 is a system work memory for operating the CPU 2001, and is also an image memory for temporarily storing image data.

Since ROM 2003 functions as a boot ROM, it stores a boot program of the system. The secondary storage device 2004 is a storage section including a hard disc drive or a nonvolatile memory, and stores system software and image data. In addition, the secondary storage device 2004 stores start parameters and other pieces of information required for the system. For example, the secondary storage device 2004 stores sheet information (sheet sizes, sheet types) of the sheets that are set in the sheet-feed units of the image forming system.

Here, the secondary storage device 2004 stores a table of the number of sheets in terms of wear for each sheet type (sheet thickness, surface finish). The table is obtained from sheet-feed tests that are performed using the sheet-feed rollers, and is stored in the secondary storage device 2004 during shipment from a factory. The table that stores the number of sheets in terms of wear is described later with reference to FIG. 4. The secondary storage device 2004 may be formed so as to store actual measurement values obtained by sheet-feed tests performed on all sheet types. Further, the secondary storage device 2004 manages, through the CPU 2001, history information of the use of sheets of the respective sheet-feed cassettes used for printing operations of jobs to be executed after the sheets are placed in the respective sheet-feed cassettes. This management may be performed by a server device on a network.

An operating section 2012 includes a display section such as a liquid crystal display, and displays a setting screen shown in FIG. 3, and receives an operation instruction from a user. An operating-section I/F 2006 is an interface section with respect to the operating section (UI) 2012, and outputs image data to be displayed on the operating section 2012 to the operating section 2012. The operating section I/F 2006 has the role of transmitting to the CPU 2001 information that has been input by a user of the system from the operating section 2012. A communication device 2009 includes a modem or a network controller, and is connected to the public line 2051 or the LAN 2052 on the network. The devices mentioned above are disposed on a system bus 2007.

An image bus interface (image bus I/F) 2005 is a bus bridge that connects the system bus 2007 and an image bus 2008

(which transfers image data at a high speed) and that converts a data structure. The image bus 2008 includes a PCI bus or IEEE 1394. The following devices are disposed on the image bus 2008.

Reference numeral 2011 denotes an image processing section that performs a RIP processing operation and a predetermined image processing operation. The RIP processing operation is one in which a PDL code received by the communication device 2009 through the LAN is developed with respect to a bit map image. The predetermined image processing operation is performed on image data that is read or print data that is generated. Here, the predetermined processing operation includes an image rotation processing operation and an image compression processing operation. The image processing section 2011 processes the image data so that a JPEG compression/expansion operation is performed on multivalued image data and a JBIG, MMR, or MH compression/expansion processing operation is performed on a binary image data.

A device I/F 2010 is connected to a reader unit 2070 and a device controller 2072, and controls an input and an output of a command or an image.

The device controller 2072 performs communication with the controller unit 1002 to control, for example, the printer unit 2095 and an apparatus power supply. The device controller 2072 communicates with the sheet-feed unit 1003 at the main body to control each processing operation.

The sheet-feed decks 1004 and 1005 are connected by ARCNET 2073, which is a high-speed data communication network.

Exemplary Structure and Specification of Embodiment

Figure 3A:
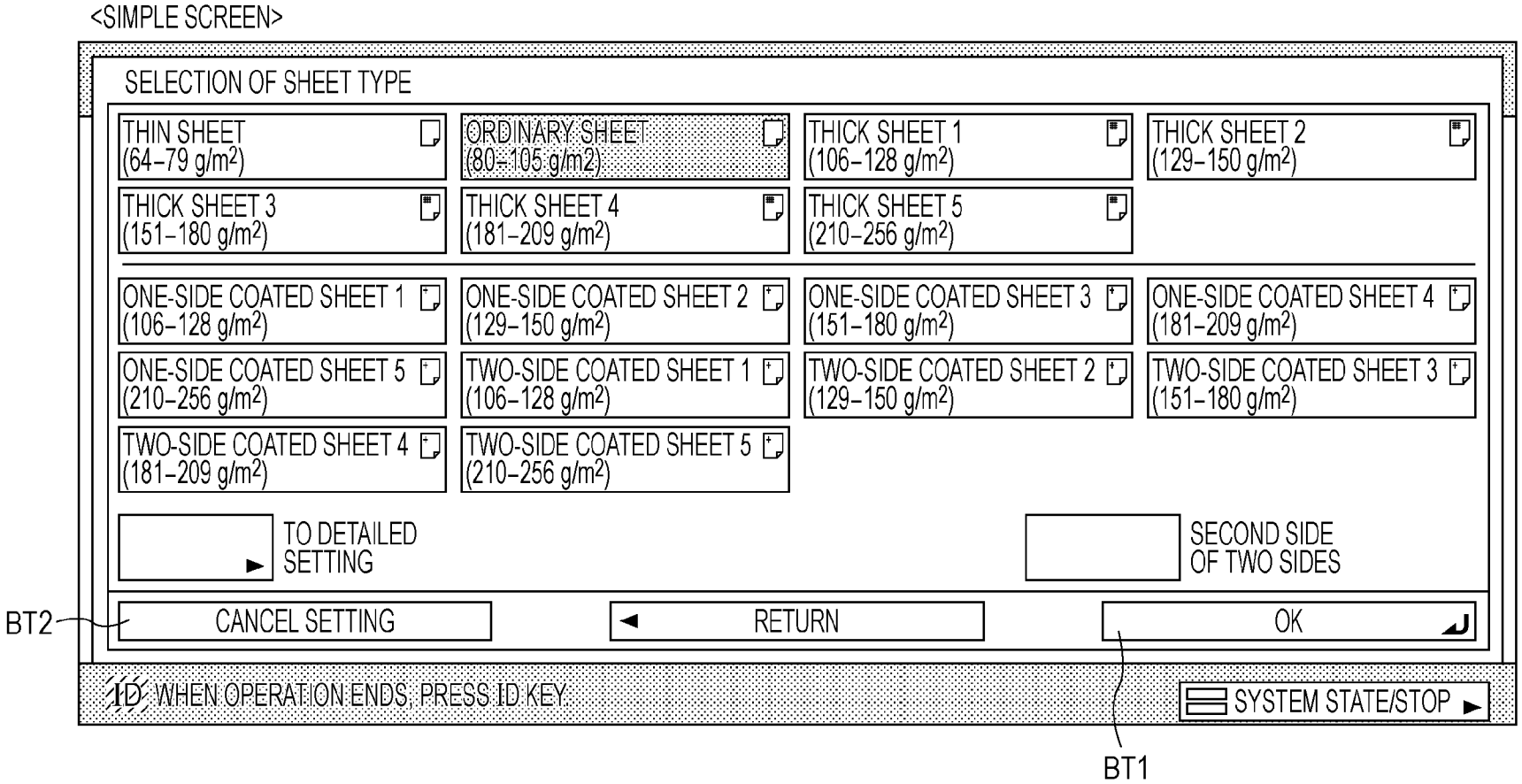
FIGS. 3A and 3B show exemplary user interfaces displayed at an operating section.
Figure 3B:
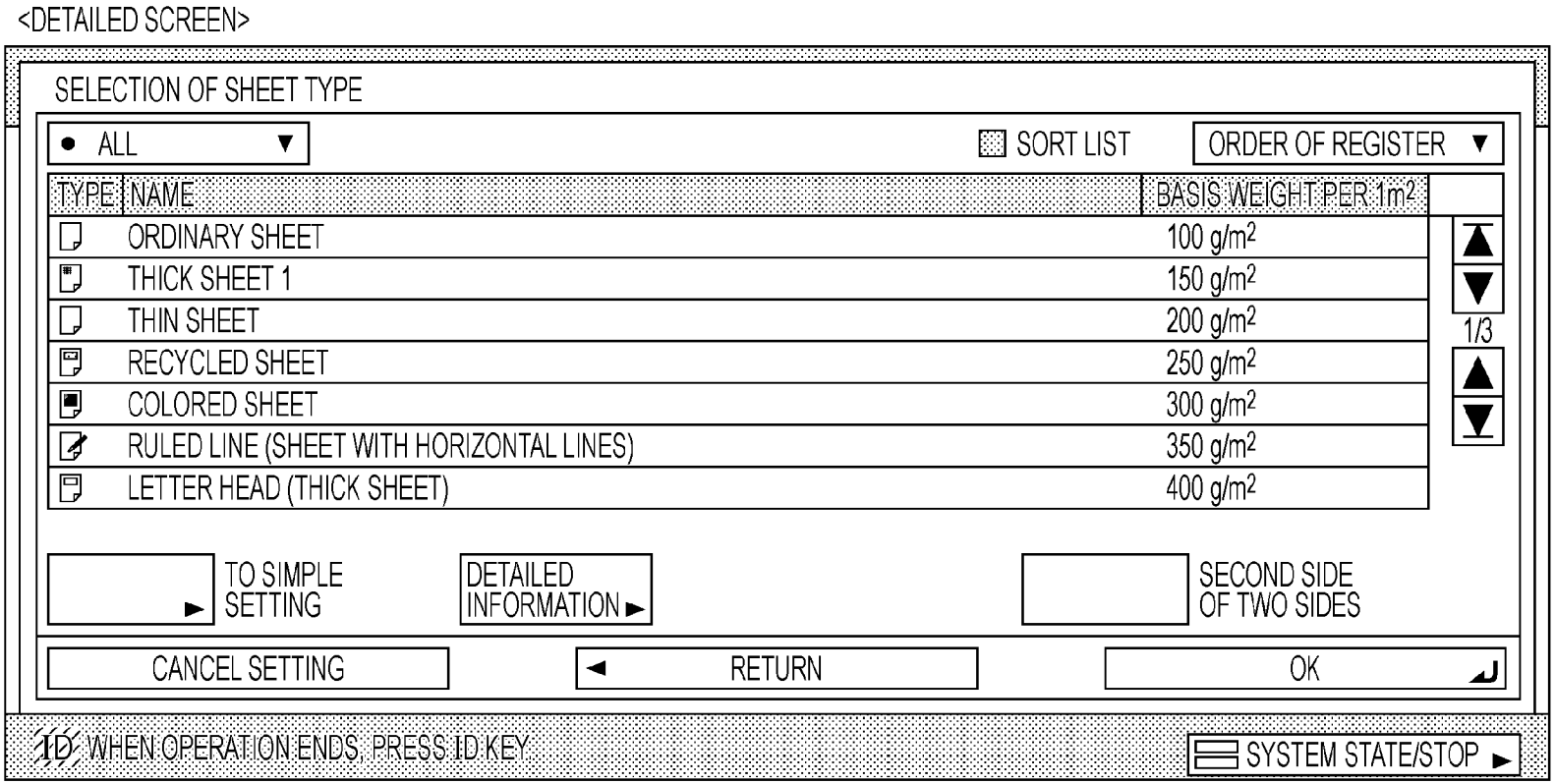

Here, FIGS. 3A and 3B (showing sheet setting screens according to the embodiment), FIG. 4 (which shows an exemplary table of the number of sheets in terms of wear), and FIG. 5 (which shows an example of history information of use of each sheet-feed cassette) will be described. Exemplary Sheet Setting Screens FIGS. 3A and 3B show exemplary operation screens (user interfaces) displayed at the operating section 2012 shown in FIG. 2. The examples are those of sheet type setting screens included in user mode functions. A user sets information of sheets set in the respective sheet-feed units through the sheet type setting screens. The user selects a user mode key provided at the operating section 2012, and presses a sheet-feed-cassette setting button to select any one of the sheet-feed cassettes C1 to C8, so that a sheet type selection screen is displayed. For the sheet type selection screen, first, a simple screen (FIG. 3A) or a detailed screen (FIG. 3B) is displayed. Whether the screen shown in FIG. 3A or the screen shown in FIG. 3B is displayed is determined by a setting that is previously set by a user.

In FIG. 3A or 3B, the content of a current setting is confirmed by pressing an OK key BT1 in FIG. 3A or FIG. 3B, and the content selected at the screen shown in FIG. 3A or at the screen shown in FIG. 3B becomes effective. For example, when the user selects the sheet-feed cassette C1 to cause the screen shown in FIG. 3A or FIG. 3B to be displayed, and selects "thick sheet 1" and presses the OK key BT1, the CPU 2001 causes "thick sheet 1" to correspond to the sheet-feed cassette C1 to register the correspondence in the secondary storage device 2004. Accordingly, the CPU 2001 causes information concerning what types of sheets are set in the sheet-feed cassettes C1 to C8 to be stored as sheet-feed cassette information in the secondary storage device 2004. Then, when the CPU 2001 executes a job whose sheet type is specified, the sheet-feed cassette in which sheets of the type specified by the job are set is selected in accordance with the sheet-feed cassette information for feeding the sheets.

On the other hand, when a cancel key BT2 is pressed, the content during the setting (during operation) becomes invalid, and the setting returns to the confirmed setting. If the OK key BT1 and the cancel key BT2 are pressed, the display of the actual setting screen ends. The display of the actual setting screen is also ended by pressing an ID key (not shown) of the operating section 2012. Exemplary Sheet-Feed-Roller Wear Sheet-Running Test FIG. 4 shows the table of the number of sheets in terms of wear. The table is used to manage information concerning the characteristics of the sheet-feed rollers of the sheet-feed unit 1003 at the main body and the sheet-feed decks 1004 and 1005 shown in FIG. 1. In FIG. 4, K represents "×1000."

The lives of the sheet-feed rollers of the sheet-feed unit 1003 at the main body and the sheet-feed decks 1004 and 1005 shown in FIG. 2 are basically determined by the numbers of sheet-running sheets. However, the numbers of sheet-running sheets until the lives of the sheet-feed rollers end differ greatly depending upon the types of sheets that are fed.

For example, Chinese sheets (embossed sheets 6 (210 to 256)) and European sheets (embossed sheets 4 (151 to 180)) recommended by manufacturers greatly influence the degrees of wear of the sheet-feed rollers. The lives of the sheet-feed rollers when such sheets are used are approximately half those of the sheet-feed rollers that feed ordinary sheets.

FIG. 4 shows a record of the relationship between the sheet types and the numbers of sheet-running sheets until the lives of the sheet-feed rollers end when the sheets of such sheet types are fed, in a certain image forming apparatus. The record is based on test results.

For example, the test results show that the lives of the sheet-feed rollers end when 500,000 ordinary sheets that are used frequently and 180,000 two-side coated sheets 6 are fed. For example, thick sheets, one-side coated sheets, and embossed sheets come in a plurality of types, and their basis weights differ from each other. For example, the basis weight of a thick sheet 2 is represented as being 129 to 150, and that of a thick sheet 3 is represented as being 151 to 180. If the basis weights of the sheets differ from each other, the degrees of wear of the sheet-feed rollers when the sheets are fed also change. Therefore, the numbers of sheets that can be fed until the lives of the sheet-feed rollers end differ from each other. In the table, as shown in FIG. 4, the sheets having different basis weights are managed separately. In the embodiment, how many A4-size sheets for the items colored gray in the table shown in FIG. 4 are to be fed in accordance with the actual test results to cause the lives of the sheet-feed rollers to end is managed. However, if necessary, test results of the items other than the items colored gray may also be managed.

Exemplary Sheet-Running State of Each Sheet-Feed Cassette

FIG. 5 shows degrees of wear resulting from wear of the sheet-feed rollers when sheets are actually fed from the sheet-feed cassettes and actually printed at the apparatus shown in FIG. 1. In the embodiment, current states of wear at the sheet-feed cassettes C1, C2, C3, C8 (C4, C5, C6, C7 are not shown) are shown. Sheet-feed managing operations including determination operations of the degrees of wear of the respective sheet-feed units calculated by the CPU 2001 will hereunder be described. In the sheet-feed managing operations, if the CPU 2001 determines that the calculated degrees of wear exceed a set threshold value, the user is notified of this state in accordance with a different flowchart described later.

Fifty thousand A4-size ordinary sheets have already been fed from the sheet-feed cassette C1. Since the amount of wear of the sheet-feed roller at the sheet-feed cassettes C1 is proportional to the sizes of the sheets, the sizes of the sheets need to be made the same for comparing the amounts of wear of the sheet-feed rollers for sheets having different sizes. Consequently, the sizes of the sheets need to be converted to a standard size. Here, the sizes of the sheets used are converted to A4-size sheets, so that the wear amount at the sheet-feed cassette C1 is calculated for 50,000 sheets. From FIG. 4, the number of ordinary sheets in terms of wear is 500,000 sheets. Therefore, the amount of wear until the life of the sheet-feed roller ends is calculated as 50,000/500,000 or 10% (the life of the sheet-feed roller is defined as being 100%).

In contrast, two types of sheets are passed at the sheet-feed cassette C2. The first type of sheet (fine-quality sheet) is "thick sheet 5." The number of A4-size sheets for the first type is 520 sheets. The second type of sheet is a one-side coated sheet 3, and has a legal (LGL) size. The number of sheets for the second type is 61,000 (after conversion to A4 size).

As shown in FIG. 4, the number of fine quality sheets (thick sheets 5) and the number of one-side coated sheets in terms of wear are 250,000 and 330,000, respectively. Therefore, the amount of wear is (520 330000/250000)+61000)/330000*100=18.6%.

Here, the value "520×330000/250000" in the aforementioned calculation formula is a value that is obtained when the degree of wear for when 5,200,000 A4-size fine quality sheets (thick sheets 5) are fed is converted into that in terms of the number of one-side coated sheets 3 that are fed.

That is, when the thick sheets 5 and the one-side coated sheets 3 are fed from the sheet-feed cassette C2, the amount of wear is the same as that when "(520×330000/250000)+61000" one-side coated sheets 3 are fed.

Here, since the number of one-side coated sheets in terms of wear is 330000, the degree of wear is ((520×330000/250000)+61000)/330000*100=18.6%. (The calculation formula may be determined by adding the degree of wear of each sheet.) For example, for the sheet-feed cassette C2, the degree of wear can be calculated by (520/250000+61000/330000)*100.

Exemplary Operation Procedure of First Embodiment

Figure 6:
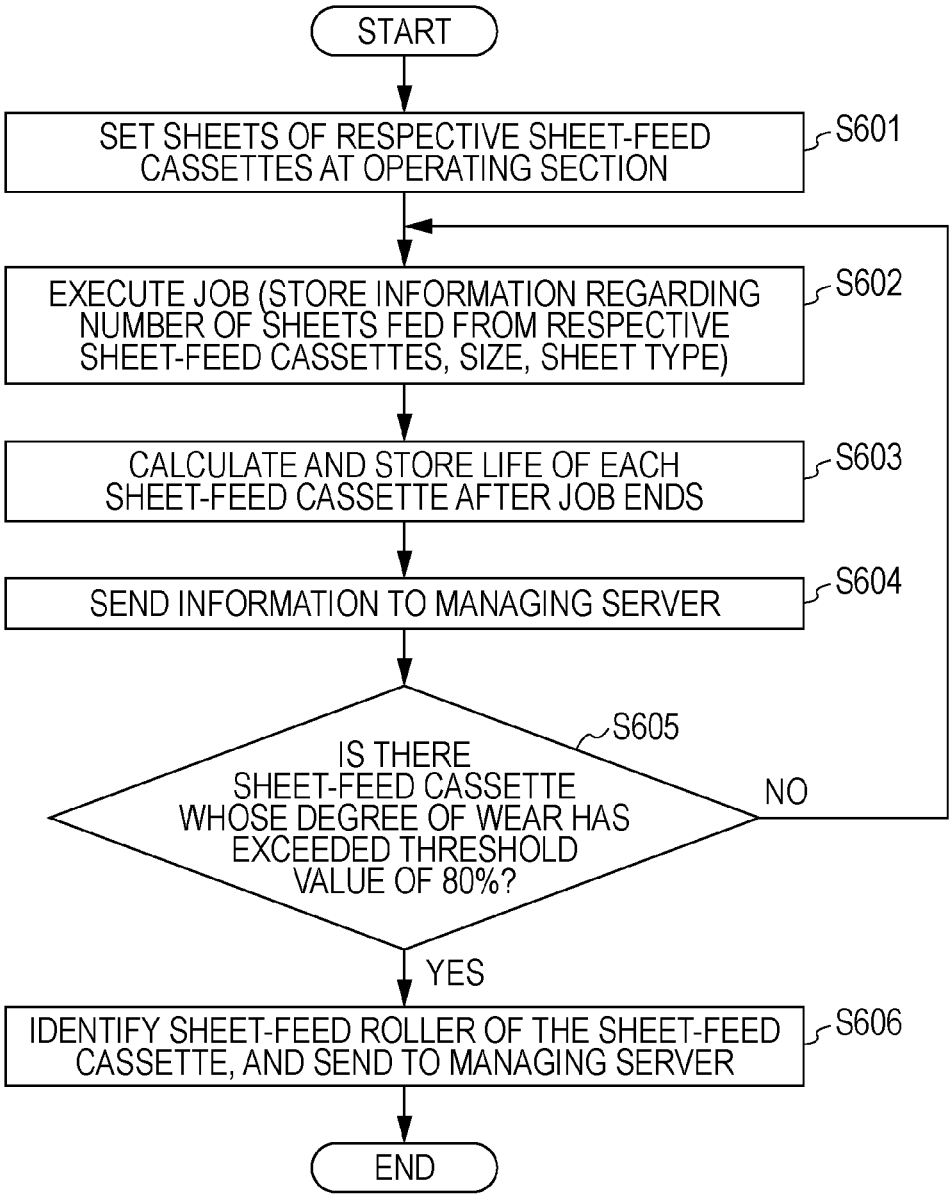
FIG. 6 is a flowchart of a procedure for controlling the image forming apparatus.

FIG. 6 is a flowchart of an exemplary controlling procedure in the image forming apparatus according to the embodiment. In the embodiment, the controlling procedure is one in which a user is notified of a sheet-feed cassette to be selected so that the degrees of wear of the sheet-feed rollers are made the same by calculating the degrees of wear of the sheet-feed rollers used in the sheet-feed cassettes of the image forming apparatus shown in FIG. 1. Reference numerals S601 to S606 denote respective steps, and are executed by the CPU 2001 when the CPU 2001 loads the control program stored in ROM 2003 to RAM 2002.

The secondary storage device 2004 stores the table of the number of sheets in terms of wear and the sheet-feed-cassette information indicating the types of sheets set in the respective sheet-feed cassettes of the image forming system. Further, the CPU 2001 causes the secondary storage device 2004 to store, as sheet-feed history information, information indicating the number of sheets that are fed from the respective sheet-feed cassettes when the image forming apparatus 1000 has performed printing. The number of sheets is counted by a counter provided for each sheet-feed unit, and the result thereof is managed by the CPU 2001.

First, in Step S601, through the simple screen shown in FIG. 3A or the detailed screen shown in FIG. 3B, the CPU 2001 receives settings from the operating section 2012 of the types of sheets that are set in the sheet-feed cassettes C1 and C2 at the main-body sheet-feed unit. In addition, the CPU 2001 receives settings of the types of sheets that are set in the sheet-feed cassettes C3 to C5 of the sheet-feed deck 1004 and the sheet-feed cassettes C6 to C8 of the sheet-feed deck 1005 through the simple screen shown in FIG. 3A or the detailed screen shown in FIG. 3B. For sheet-feed cassettes whose settings of types of sheets are not received, the CPU 2001 performs the following controlling operations using the setting of the type of sheets that is set until this time. In addition to the types of sheets, the CPU 2001 receives information regarding the sizes of the sheets for each sheet-feed cassette through the operating section 2012.

Next, in Step S602, the CPU 2001 executes a job received from the operating section 2012 or a job received through a network. The job received from the operating section 2012 is, for example, a copy job or a BOX print job. The copy job is a job of reading an image of an original with the scanner 1001 and printing the read image of the original onto a sheet having a size corresponding to the size of the original or a sheet having a size specified by a user. The BOX print job is a job of storing image data and print setting information (specified by the user) as jobs in the secondary storage device 2004 and executing a printing operation of the image data on the basis of the print setting information in accordance with an instruction of the user. The print setting information includes information regarding the types and sizes of the sheets. In accordance with the information regarding the types and sizes of the sheets, the CPU 2001 selects the sheet-feed unit at which sheets of the type and size indicated by the information are set to feed the sheets. It is possible for the print setting information not to include the information regarding the types of sheets and to only include the information regarding the sizes of the sheets, and for the CPU 2001 to cause sheets to be fed from the sheet-feed cassette where the sheets of the proper size are set to print the sheets.

The job received through the network is a print job. The print job is a job of feeding sheets from any one of the main body sheet-feed unit 1003, the sheet-feed deck 1004, and the sheet deck 1005 and printing the feeding sheets on the basis of the print setting information transmitted from an external computer. The print setting information includes information regarding the types and sizes of the sheets. In accordance with the information regarding the sizes and types of sheets, the CPU 2001 selects the sheet-feed unit in which sheets of the size and type indicated by the information are set to feed the sheets. It is possible for the print setting information not to include the information regarding the types of sheets and to only include the information regarding the sizes of the sheets, and for the CPU 2001 to cause sheets to be fed from the sheet-feed cassette where the sheets of the proper size are set to print the sheets.

Here, if there are a plurality of sheet-feed cassettes where the sheets of the proper size and type specified by a job exist, the CPU 2001 performs control so as to preferentially select the sheet-feed cassette whose sheet-feed roller has a degree of wear of 80% or less. This makes it possible to make equal the degrees of wear of the sheet-feed rollers of the sheet-feed cassettes of the image forming system. If the sheet-feed cassette used in executing a job is directly specified instead of selecting the sheet-feed cassette in accordance with the sheet size and sheet type, the CPU 2001 selects the specified sheet-feed cassette and executes the job regardless of the degree of wear of the sheet-feed roller. Alternatively, the CPU 2001 may notify the user of a message indicating the necessity of replacing the sheet-feed roller of the sheet-feed cassette specified by the job.

The CPU 2001 can execute jobs other than the copy job, the BOX job, and the print job.

Here, when the CPU 2001 executes a job, the information regarding the types of sheets, the sizes of the sheets, and the numbers of sheets fed from the respective sheet-feed cassettes is stored as sheet-feed history information in the secondary storage device 2004.

Next, in Step S603, the CPU 2001 calculates the life of each sheet-feed cassette when the job ends. More specifically, the CPU 2001 calculates the degree of wear of each sheet-feed cassette as described with reference to FIG. 5.

More specifically, when the CPU 2001 executes a job, the CPU 2001 obtains information of the type and the size of sheets specified by the job. Then, the CPU 2001 selects the sheet-feed cassette where the sheets of the proper size and type specified by the job are set, starts feeding the sheets from the selected sheet-feed cassette, and causes printing to be performed on the sheets. The CPU 2001 counts how many sheets have been fed from the sheet-feed cassette using a counter (not shown), and causes the sheet-feed history information such as that shown in FIG. 5 to be stored in the secondary storage device 2004. A value resulting from counting the number of sheets is stored in the secondary storage device 2004 after the value is managed at RAM 2002. After the execution of the job ends, the CPU 2001 proceeds to Step S604. In Step S604, after the job ends, the CPU 2001 refers to the table of the number of sheets in terms of wear stored in the secondary storage device 2004, and obtains information regarding the number of sheets in terms of wear corresponding to the sheet type specified by the job from the table.

If the sheet size specified by the job is a size other than the A4 size (210 mm in a sheet-feed direction), the number of fed sheets converted to that of A4-size sheets is calculated and is stored in the secondary storage device 2004.

Next, the CPU 2001 calculates the degree of wear from the obtained parameters (number of sheets in terms of wear dependent upon the sheet type, the number of printings after the conversion), and information regarding the degree of wear of each sheet-feed roller of each sheet-feed cassette is stored in RAM 2002 or the secondary storage device 2004.

Then, in Step S604, the communication device 2009 notifies a managing server (not shown) of the information regarding the degree of wear of each sheet-feed cassette through the LAN 2052 or the WAN 2051. The managing server is a server used by an administrator or a service personal for managing and maintaining the image forming apparatus. The managing server is connected to a plurality of image forming systems, and causes transmitted information to correspond to each image forming system and each piece of information to be managed at a storage section. In Step S604, the CPU 2001 may cause the display section of the operating section 2012 to display the information regarding the degree of wear.

Next, in Step S605, the CPU 2001 determines whether or not there exists a sheet-feed roller whose degree of wear exceeds a threshold value (80% in the embodiment) among the sheet-feed rollers of the sheet-feed cassettes. Here, if the CPU 2001 determines that there exists a sheet-feed cassette (the sheet-feed cassette C3 in the embodiment) whose degree of wear exceeds 80%, the process proceeds to Step S606. In contrast, if the CPU 2001 determines that a sheet-feed roller whose degree of wear exceeds the threshold value (80% in the embodiment) does not exist among the sheet-feed rollers of the sheet-feed cassettes, the process returns to Step S602.

In Step S606, the communication device 209 notifies the managing server of information regarding the sheet-feed roller through the LAN 2052 or the WAN 2051, and the process ends. Here, the information regarding the sheet-feed roller of which the user is notified includes information regarding the necessity of replacing the sheet-feed roller of which sheet-feed cassette of which image forming system.

The communication device 209 notifies the managing server of information other than the aforementioned information by adding, for example, information regarding serial numbers characteristic of image forming apparatuses and information regarding users that use the image forming apparatus 1000. This makes it possible to indentify, for example, the service personnel or the administrator corresponding to the serial number or the user information managed by the managing server, to give a notification in accordance with a registered notification method. The content of the notification indicates the sheet-feed roller of which sheet-feed cassette of which image forming apparatus 1000 (image forming system) has reached the end of its life and needs replacement. In addition, the service personnel can give an instruction for inspecting or replacing the sheet-feed roller. The notification may be made using a display section of the managing server or by sound. Alternatively, the managing server may make the notification by, for example, sending an email to a terminal of the service personnel or the administrator.

By performing the above-described control, the degrees of wear of the sheet-feed rollers corresponding to the sheet-feed cassettes can be managed considering the sizes or types of sheets. In addition, it is possible to notify the managing server of the sheet-feed roller that requires replacement among the sheet-feed rollers of the sheet-feed cassettes, so that the service personnel can arrange for the replacement of the sheet-feed roller as appropriate.

Second Embodiment

In the above-described embodiment, by a job executed at the image forming apparatus, the degrees of wear of the sheet-feed rollers are calculated for the sheets that are set in the respective sheet-feed cassettes, and the managing server is notified of the inspection and replacement of the sheet-feed roller or sheet-feed rollers. In contrast, in the second embodiment described below, if a user selects a sheet-feed cassette when the degree of wear exceeds a set threshold value, a notification is made for replacing the type of sheets corresponding to the sheet-feed cassette whose degree of wear has exceeded the threshold value or for selecting another sheet-feed cassette.

Figure 7A:
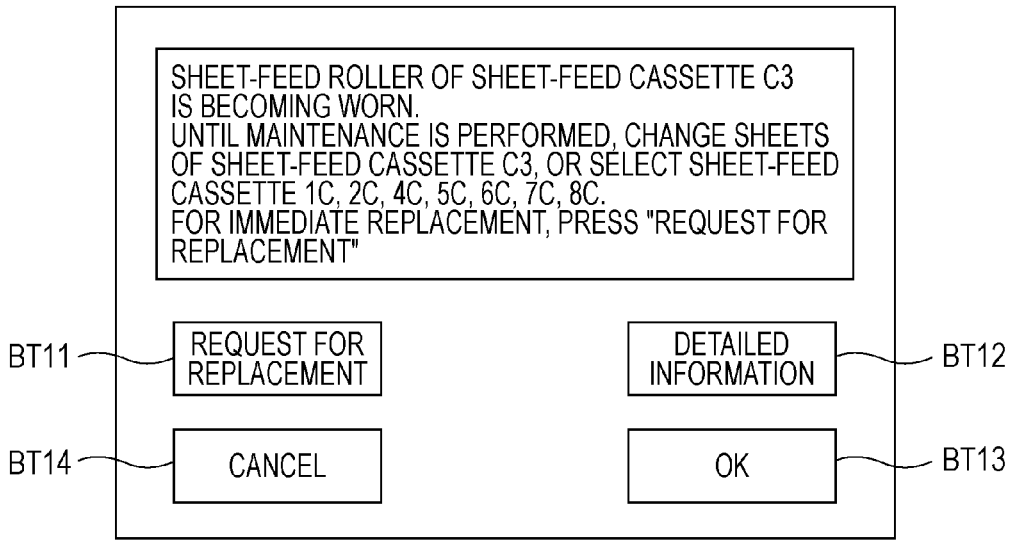
FIGS. 7A and 7B show exemplary user interfaces displayed at the operating section.
Figure 7B:
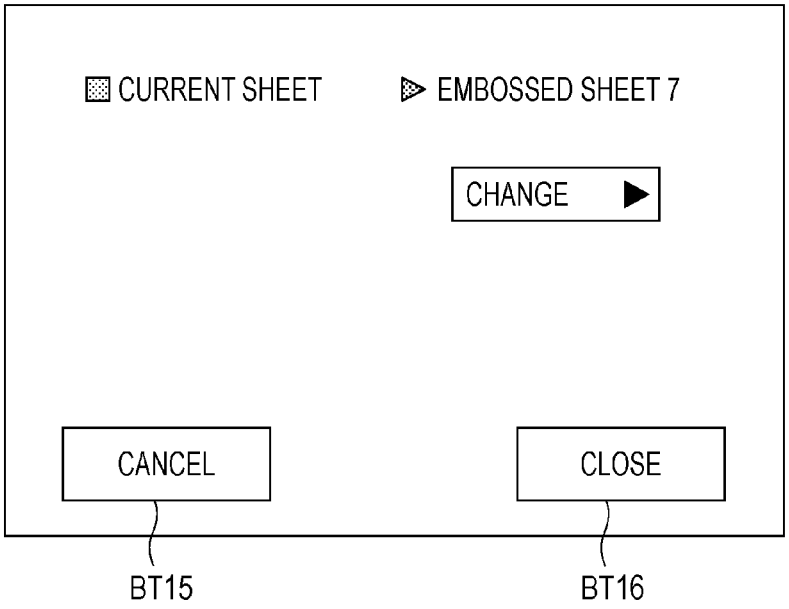

FIGS. 7A and 7B show exemplary user interfaces displayed at the operating section 2012 shown in FIG. 2. In the embodiment, the CPU 2001 executes the control program stored in ROM 2003 to display the control program on the operating section 2012.

In the second embodiment, a change in the sheet type with respect to the sheet-feed cassette C3 shown in FIG. 1 is selected. In particular, FIG. 7A shows a screen displayed in Step S806 (described later) in FIG. 8, and FIG. 7B shows a sheet-type setting screen displayed when a button BT11 is selected on the screen shown in FIG. 7A.

Figure 8:
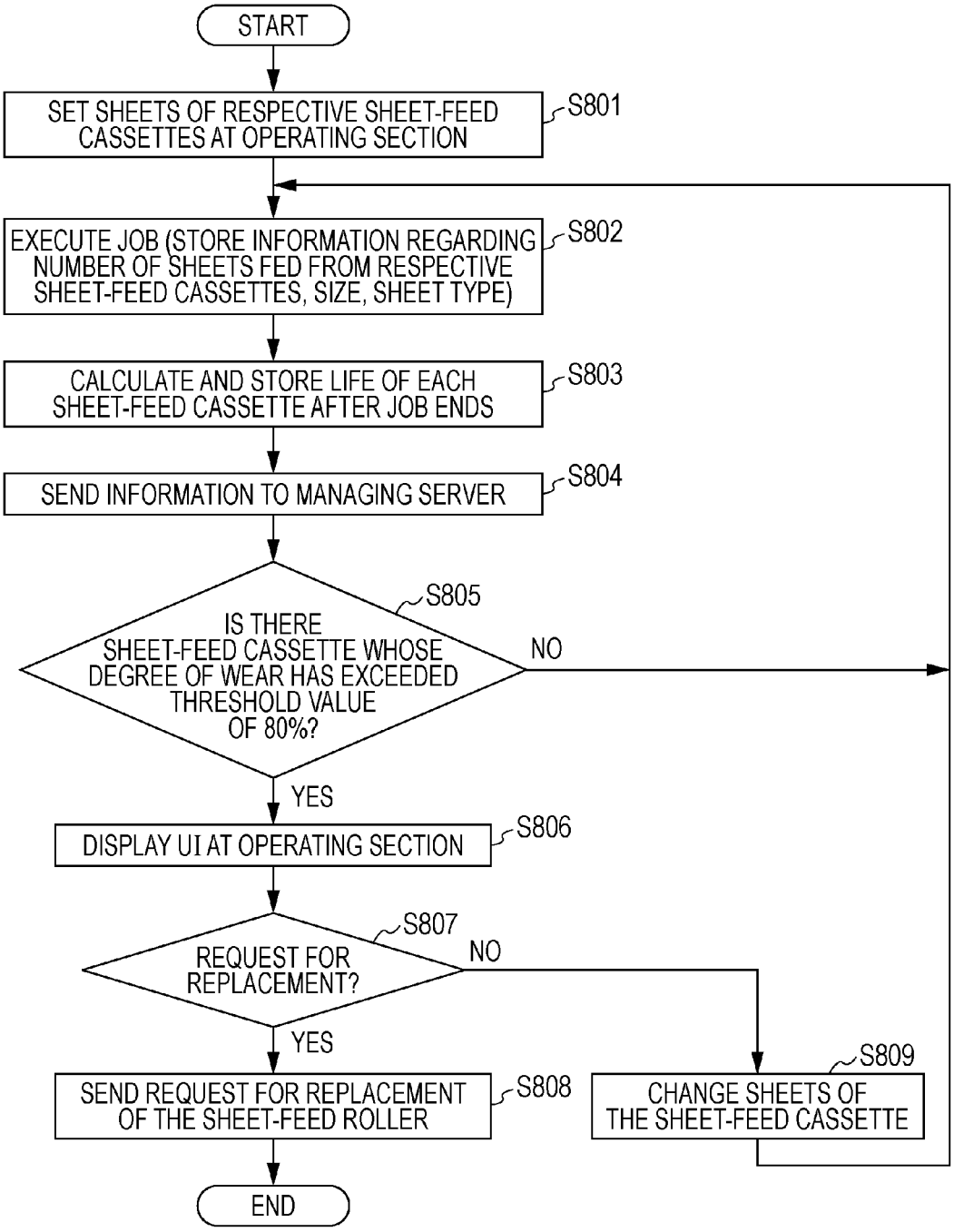
FIG. 8 is a flowchart of a procedure for controlling the image forming apparatus.

FIG. 8 is a flowchart of an exemplary procedure for controlling an image forming apparatus according to the second embodiment. In the second embodiment, in addition to performing the steps shown in FIG. 6, notification of changing the sheet type to be set for the sheet-feed cassette or of selecting another sheet-feed cassette is given to the user. Reference numerals S801 to S809 denote respective steps, and are executed when the CPU 2001 loads the control program stored in ROM 2003 to RAM 2002 and executes the control program. The Steps S801 to S805 are the same as the Steps S601 to S605, so that they will not be described below.

The secondary storage device 2004 holds information regarding the numbers of sheets in terms of wear of the sheet-feed rollers corresponding to the sheet-feed cassettes that are referred to in the control. In addition, the secondary storage device 2004 holds counter information indicating the number of sheets fed from the respective cassettes when the image forming apparatus 1000 has executed a printing operation.

In Step S806, the CPU 2001 causes the screen shown in FIG. 7A to be displayed on the operating section 2012. The screen shown in FIG. 7A displays a message for notifying the user that wear of the sheet-feed roller corresponding to the sheet-feed cassette C3 is increasing. Until maintenance is performed, the screen shown in FIG. 7A displays a message for setting sheets of a type resulting in a low degree of wear of the sheet-feed roller in the sheet-feed cassette for reducing the wear of the sheet-feed roller corresponding to the sheet-feed cassette C3. Further, when a job is to be executed in the future, a message for urging execution of the job by specifying a sheet-feed cassette other than the sheet-feed cassette C3 is displayed. If the user does not want to replace the sheet-feed roller immediately, a message for making a notification to press a replacement request button is displayed. Here, the case in which all of the messages are displayed is described. However, some of the messages may be displayed.

Here, the user confirms a current state on the basis of a message displayed on the screen shown in FIG. 7A of the operating section 2012. Then, set sheets are changed for the user so that the degree of wear of the sheet-feed roller corresponding to the sheet-feed cassette C3 does not increase. For example, the CPU 2001 urges the user to set a sheet type that causes a smaller degree of wear. Here, the CPU 2001 waits for an instruction from the user with regard to a button displayed on the operating section 2012.

In addition, in Step S807, the CPU 2001 determines whether or not the button BT11 selected by the user and indicating that the sheet-feed roller corresponding to the sheet-feed cassette C3 is to be replaced has been pressed. Here, if the CPU 2001 determines that the user has pressed the button BT11, the process proceeds to Step S808 to make a request to the managing server to replace the sheet-feed roller of the sheet-feed cassette C3. Then, the actual process ends. Although the replacement request is given by sending an email to a previously registered address, the replacement request may be given by methods other than by sending an email.

In contrast, if the CPU 2001 determines that the user specifies detailed information of the button BT12, the process proceeds to Step S809, so that the operating section 2012 provides the setting screen shown in FIG. 7B. In Step S809, the CPU 2001 performs "not used"/"change" operation on the selected sheet-feed cassette C3 in accordance with the content selected by the user on the screen shown in FIG. 7B.

In the example shown in FIG. 7B, the user can change the sheet type that is set in the sheet-feed cassette C3 in accordance with the message shown in FIG. 7A. In the embodiment, in order to change the sheet type that is set in the sheet-feed unit 3, when a "change" button is pressed, possible sheet selections can be presented to the user. Here, the possible sheet selections that are displayed are desirably those causing the sheet-feed roller to have a small degree of wear than the sheets that are set in the current sheet-feed cassette (displayed in "current sheet" column). More specifically, of the sheet types that are stored in the table of the numbers of sheets in terms of wear, the sheet types whose numbers of sheets in terms of wear are higher than that of the currently set sheets are presented as possible sheet selections. By this, the user can limit the setting of sheet types that cause further wear in the sheet-feed cassette C3. In addition, even if the user does not know the numbers of sheets in terms of wear for the respective sheet types, the user can select a sheet type causing the sheet-feed roller to have a small degree of wear (that is, number of sheets in terms of wear is large).

Here, when a sheet-feed cassette is selected, it is possible to display sheet types starting with the sheet type that is the same as the sheet type that is set in the sheet-feed cassette C3. For example, if a pull-down menu is displayed when the "change" button is pressed, sheets of the same type as an embossed sheet 7 (such as an embossed sheet 4 and embossed sheets) are displayed on the upper side of the pull-down menu. Accordingly, in the embodiment, the wear of the sheet-feed roller can be reduced by changing the sheet type that is set in the sheet-feed cassette C3 to a sheet type that has little influence on the wear of the sheet-feed roller.

By performing the above-described control, the degree of wear of a sheet-feed roller corresponding to a sheet-feed cassette can be controlled by considering the size or type of sheets. In addition, it is possible to notify the managing server that a sheet-feed roller needs replacement among the sheet-feed rollers of the sheet-feed cassettes to allow a service personnel to arrange for the replacement as appropriate. The user can easily know the sheet-feed cassette whose sheet-feed roller is considerably worn, and to quickly make a request to replace the sheet-feed roller, to change the sheets, etc.

In addition, if the user changes the sheet type that is set at the sheet-feed cassette C3 to a sheet type having little influence on wear, the degrees of wear of the sheet-feed rollers can be equalized. As a result, when a service personnel replaces a sheet-feed roller of the image forming apparatus 1000, the CPU 2001 confirms the degrees of wear of the sheet-feed rollers at the respective sheet-feed cassettes that are held in and managed by the secondary storage device 2004. In addition, the sheet-feed rollers of the respective sheet-feed cassettes whose degrees of wear have increased to a certain level can be replaced together, so that the efficiency with which the sheet-feed rollers are replaced can be increased.

In the embodiment, when the user wants to replace a sheet-feed roller of a sheet-feed cassette that is considerably worn, the user can make a notification to the managing server to replace the sheet-feed roller by a simple operation of pressing the button BT11.

Other Embodiments

Although, in the embodiments, the degree-of-wear threshold value is 80%, the user can set the threshold value to any value. Alternatively, a notification can be made when the life of a sheet-feed roller ends (100%).

In addition, although, in the embodiments, the number of sheet-feed units is two, the present invention may obviously be carried out for the number of decks that can be connected.

Although, in the embodiments, the sheet-feed cassettes are used as exemplary feeding units, the feeding units may be sheet-feed trays such as manual sheet trays or insert trays. Further, the degrees of wear of the sheet-feed rollers are used as examples of the lives of the sheet-feed cassettes. However, when there are component parts that are worn due feeding sheets other than the sheet-feed rollers, it is possible to manage the degrees of wear thereof and to make a notification of the degrees of wear.

Although, in the embodiments, the present invention is applied to a system including a plurality of devices (such as a host computer, an interface device, a reader, a printer), the present invention may be applied to an apparatus (such as a copying apparatus or a printer apparatus) including one device.

In the embodiments, the case in which the CPU 2001 of the image forming apparatus 1000 performs various control operations such as those illustrated in the flowcharts is described. However, it is possible for the sheet-feed decks 1004 and 1005 to have structures corresponding to that of the controller unit 1002 and to perform these control operations as a managing apparatus. In addition, it is possible for a print server connected to the image forming system to have a structure corresponding to that of the controller unit 1002 and to perform these control operations as a managing apparatus.

Although, in the embodiments, the managing server is assumed as being a stationary information processing apparatus, the present invention is obviously applicable to a portable information processing apparatus (such as a notebook personal computer).

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-175381, filed Jul. 28, 2009, which is hereby incorporated by reference herein in its entirety.

What is claimed is:

1. An apparatus for feeding a sheet stored in a sheet storage unit by using a feeding component, comprising:

a memory unit configured to store, for each kind of sheets, information indicating influence on wear of the feeding component;

a determining unit configured to determine whether a degree of wear of a feeding component for feeding a first kind of sheet stored in the sheet storage unit is a predetermined degree of wear; and a control unit configured to prompt, based on the information stored in the memory unit, a user to set, in the sheet storage unit, a second kind of sheet in a case where the determining unit determines that the degree of wear of the feeding component is the predetermined degree of wear, influence on wear of the feeding component by feeding one sheet corresponding to the second kind of sheet being smaller than influence on wear of the feeding component by feeding one sheet corresponding to the first kind of sheet.

2. The apparatus according to claim 1, further comprising a notification unit configured to, in a case where the determining unit determines that the degree of wear of the feeding component is the predetermined degree of wear, prompt a user to replace the feeding component.

3. The apparatus according to claim 2, wherein the notification unit notifies a managing server of the replacement of the feeding component through a network.

4. The apparatus according to claim 1, wherein the control unit displays a plurality of second kinds of sheets.

5. The apparatus according to claim 4, further comprising a receiving unit configured to receive a selection of a second kind of sheet from among the plurality second kinds of sheets.

6. The apparatus according to claim 1, further comprising a plurality of sheet storage units, wherein the determining unit determines whether a degree of wear of each of the feeding components is the predetermined degree of wear.

7. The apparatus according to claim 1, wherein the first kind of sheet is a first size of sheet, and the second kind of sheet is a second size of sheet.

8. The apparatus according to claim 1, wherein the first kind of sheet is a first type of sheet, and the second kind of sheet is a second type of sheet.

9. A control method for controlling an apparatus for feeding a sheet stored in a sheet storage unit by using a feeding component, the control method comprising:

storing, in a memory unit, for each kind of sheets, information indicating influence on wear of the feeding component;

determining whether a degree of wear of a feeding component for feeding a first kind of sheet stored in the sheet storage unit is a predetermined degree of wear; and prompting, based on the information stored in the memory unit, a user to set, in the sheet storage unit, a second kind of sheet in a case where it is determined that the degree of wear of the feeding component is the predetermined degree of wear, influence on wear of the feeding component by feeding one sheet corresponding to the second kind of sheet being smaller than influence on wear of the feeding component by feeding one sheet corresponding to the first kind of sheet.

10. A computer readable storage medium for storing a computer program for controlling an apparatus for feeding a sheet stored in a sheet storage unit by using a feeding component, the computer readable storage medium comprising:

a code to store, in a memory unit, for each kind of sheets, information indicating influence on wear of the feeding component; a code to determine whether a degree of wear of a feeding component for feeding a first kind of sheet stored in the sheet storage unit is a predetermined degree of wear; and a code to prompt, based on the information stored in the memory unit, a user to set, in the sheet storage unit, a second kind of sheet in the sheet storage unit in a case where it is determined that the degree of wear of the feeding component is the predetermined degree of wear, influence on wear of the feeding component by feeding one sheet corresponding to the second kind of sheet being smaller than influence on wear of the feeding component by feeding one sheet corresponding to the first kind of sheet.

11. An image forming apparatus for forming an image on a sheet which is fed from a sheet storage unit by using a feeding component, the image forming apparatus comprising:

a memory unit configured to store, for each kind of sheets, information indicating influence on wear of the feeding component;

a determining unit configured to determine whether a degree of wear of a feeding component for feeding a first kind of sheet stored in the sheet storage unit is a predetermined degree of wear; and a control unit configured to prompt, based on the information stored in the memory unit, a user to set, in the sheet storage unit, a second kind of sheet which has smaller influence on wear of the feeding component than the sheet stored in the sheet storage unit in a case where the determining unit determines that the degree of wear of the feeding component is the predetermined degree of wear, influence on wear of the feeding component by feeding one sheet corresponding to the second kind of sheet being smaller than influence on wear of the feeding component by feeding one sheet corresponding to the first kind of sheet.

* * * * *